US007971976B2

(12) United States Patent
Ishizawa et al.

(10) Patent No.: US 7,971,976 B2
(45) Date of Patent: Jul. 5, 2011

(54) LIQUID STORAGE CONTAINER

(75) Inventors: Taku Ishizawa, Matsumoto (JP); Satoshi Shinada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1040 days.

(21) Appl. No.: 11/690,791

(22) Filed: Mar. 23, 2007

(65) Prior Publication Data

US 2008/0018718 A1 Jan. 24, 2008

(30) Foreign Application Priority Data

Mar. 24, 2006 (JP) ..... 2006-083051
Mar. 24, 2006 (JP) ..... 2006-083052
Aug. 11, 2006 (JP) ..... 2006-220756

(51) Int. Cl.
*B41J 2/175* (2006.01)

(52) U.S. Cl. ..... 347/86

(58) Field of Classification Search ..... 385/84–86, 385/92, 95, 97, 100; 347/84–86, 92, 95, 347/97, 100

See application file for complete search history.

(56) References Cited

U.S. PATENT DOCUMENTS 4,969,759 A 11/1990 Suzuki et al.
5,156,470 A 10/1992 Suzuki et al.
5,156,471 A 10/1992 Suzuki et al.
5,156,472 A 10/1992 Suzuki et al.
5,156,473 A 10/1992 Suzuki et al.
5,158,377 A 10/1992 Suzuki et al.
5,174,665 A 12/1992 Suzuki et al.
5,221,148 A 6/1993 Suzuki et al.
5,328,279 A 7/1994 Suzuki et al.
5,421,658 A 6/1995 Suzuki et al.
5,477,963 A 12/1995 Mochizuki et al.
5,488,401 A 1/1996 Mochizuki et al.
5,560,720 A 10/1996 Suzuki et al.
5,576,749 A 11/1996 Mochizuki et al.
5,590,510 A 1/1997 Mochizuki et al.
5,603,577 A 2/1997 Suzuki et al.
5,607,242 A 3/1997 Suzuki et al.
5,615,957 A 4/1997 Suzuki et al.
5,622,439 A 4/1997 Suzuki et al.
5,657,058 A 8/1997 Mochizuki et al.
5,682,189 A 10/1997 Takagi
5,790,158 A 8/1998 Shinada et al.
5,801,737 A 9/1998 Sato et al.
5,877,794 A 3/1999 Takagi
6,045,207 A 4/2000 Mochizuki et al.
6,070,976 A 6/2000 Takagi et al.

(Continued)

FOREIGN PATENT DOCUMENTS

CN 1274645 A 11/2000

(Continued)

*Primary Examiner* — Charlie Peng
(74) *Attorney, Agent, or Firm* — Sughrue Mion, PLLC

(57) ABSTRACT

A liquid storage container prevents quality degradation of liquid caused by evaporation of moisture in the liquid stored in a liquid storage chamber and contact between the liquid and air introduced into the liquid storage chamber. Quality is stably maintained for a long time. As ink contained in a liquid storage chamber is consumed, an atmosphere communicating path guides air into the liquid storage chamber from the outside. The atmosphere communicating path has a thin communicating path at an intermediate position. The thin communicating path is thinner than other portions and is capable of holding ink by a meniscus. An amount of ink sufficient for blocking the ink contained in the liquid storage chamber from the atmospheric air is held in the thin communicating path.

7 Claims, 12 Drawing Sheets

U.S. PATENT DOCUMENTS

| | | | | |
|---|---|---|---|---|
| 6,123,469 | A | 9/2000 | Suzuki et al. | |
| 6,145,974 | A | 11/2000 | Shinada et al. | |
| 6,176,629 | B1 | 1/2001 | Suzuki et al. | |
| 6,224,275 | B1 | 5/2001 | Suzuki et al. | |
| 6,231,248 | B1 | 5/2001 | Suzuki et al. | |
| 6,247,803 | B1 | 6/2001 | Kanaya et al. | |
| 6,470,744 | B1 | 10/2002 | Usui et al. | |
| 6,719,408 | B2 * | 4/2004 | Yoshihira et al. | 347/87 |
| 6,723,147 | B2 | 4/2004 | Mashiko et al. | |
| 6,726,315 | B2 | 4/2004 | Koizumi et al. | |
| 6,761,445 | B2 * | 7/2004 | Hoen et al. | 347/92 |
| 6,848,776 | B2 | 2/2005 | Nishioka et al. | |
| 7,097,293 | B2 | 8/2006 | Ichihashi et al. | |
| 7,125,108 | B2 | 10/2006 | Toba et al. | |
| 7,147,309 | B2 | 12/2006 | Sakai et al. | |
| 7,222,949 | B2 | 5/2007 | Ichihashi et al. | |
| 7,249,832 | B2 | 7/2007 | Sakai et al. | |
| 2004/0017446 | A1 * | 1/2004 | Ando et al. | 347/85 |
| 2004/0218026 | A1 * | 11/2004 | Matsushita et al. | 347/93 |
| 2005/0041077 | A1 | 2/2005 | Lee | |
| 2006/0203053 | A1 * | 9/2006 | Katsumura | 347/86 |
| 2007/0040859 | A1 * | 2/2007 | Kimura | 347/7 |

FOREIGN PATENT DOCUMENTS

| | | | |
|---|---|---|---|
| CN | 1116987 | C | 8/2003 |
| CN | 1440875 | A | 9/2003 |
| JP | 54-061934 | A | 5/1979 |
| JP | 6-255122 | A | 9/1994 |
| JP | 2563769 | B2 | 9/1996 |
| JP | 10-095128 | A | 4/1998 |
| JP | 2001-146030 | | 5/2001 |
| JP | 2001-328278 | A | 11/2001 |
| JP | 2002-036580 | | 2/2002 |
| JP | 2003-112435 | A | 4/2003 |
| JP | 2004-209847 | | 7/2004 |
| JP | 2004-237720 | A | 8/2004 |
| JP | 2004-249707 | A | 9/2004 |
| JP | 2005-161634 | A | 6/2005 |

* cited by examiner

LIQUID STORAGE CONTAINER

TECHNICAL FIELD

The present invention relates to a liquid storage container opened to the atmosphere, having a container main body that is detachably attached to a liquid-consuming apparatus, and supplying liquid contained in the container main body to the liquid-consuming apparatus.

BACKGROUND ART

An ink cartridge that is opened to the atmosphere and that contains liquid ink and an ink jet recording apparatus (ink jet printer) to which the ink cartridge is exchangeably attached are examples of a known liquid storage container and a known liquid-consuming apparatus, respectively.

The ink cartridge generally has a container main body that is detachably attached to a cartridge-receiving unit of the ink jet recording apparatus. The container main body includes an ink storage chamber that is filled with ink, an ink-supplying unit for supplying the liquid contained in the ink storage chamber to the ink jet recording apparatus, an ink guide path through which the ink storage chamber and the ink-supplying unit communicate with each other, and an atmosphere communicating path for allowing air to flow into the ink storage chamber from the outside as the ink contained in the ink storage chamber is consumed. When the ink cartridge is attached to the cartridge-receiving unit of the ink jet recording apparatus, an ink supply needle included in the cartridge-receiving unit is connected to the ink-supplying unit by being inserted therein, so that the can be supplied to a recording head included in the ink jet recording apparatus.

The recording head included in the ink jet recording apparatus controls an operation of ejecting ink drops using heat or vibration. If the ink-ejecting operation is performed when there is no more ink in the ink cartridge and no ink can be supplied, the recording head will break down. Therefore, in the ink jet recording apparatus, it is necessary to monitor the amount ink remaining in the ink cartridge so as to prevent the recording head from operating when there is no ink.

In light of the above situation, an ink cartridge has been developed which includes a liquid remaining-amount sensor that outputs a predetermined electrical signal when the amount of ink remaining in a container main body is reduced to a predetermined threshold, so that a recording head included in a recording apparatus can be prevented from operating after the ink contained in the ink cartridge runs out (see, for example, JP-A-2001-146030).

In the known ink cartridge that is opened to the atmosphere, the ink storage chamber is always vented to the atmosphere through the atmosphere communicating path. Therefore, moisture included in the ink stored in the ink storage chamber is evaporated through the atmosphere communicating path. Accordingly, viscosity of the ink is increased due to the evaporation of the moisture. As a result, there is a risk that the printing performance of the ink jet recording apparatus will be influenced.

In addition, since natural ventilation of the atmospheric air in the ink storage chamber occurs through the atmosphere communicating path, the ink contained in the ink storage chamber often comes into contact with fresh air. Therefore, in the long view, there is a possibility that the quality of the ink will be degraded due to the contact with air.

SUMMARY OF THE INVENTION

Accordingly, an object of the present invention is to solve the above-described problems and to provide a liquid storage container which is opened to the atmosphere, which prevents an increase in the viscosity of liquid due to moisture evaporation through an atmosphere communicating path, and which regulates the air ventilation in the liquid storage chamber to suppress the quality degradation of the liquid due to contact between the liquid and fresh air, thereby stably maintaining the quality of the liquid for a long time.

The above-described object of the present invention can be achieved by a liquid storage container that is opened to the atmosphere, that is attached to a liquid-consuming apparatus, and that includes: a liquid storage chamber that stores liquid; a liquid-supplying unit connected to the liquid-consuming apparatus; a liquid guide path for guiding the liquid contained in the liquid storage chamber to the liquid-supplying unit; an atmosphere communicating path that allows atmospheric air to flow into the liquid storage chamber from the outside as the liquid in the liquid storage chamber is consumed; and a liquid remaining-amount sensor disposed at an intermediate position of the liquid guide path and determining that the liquid in the liquid storage chamber has run out when a flow of gas into the liquid guide path is detected.

The atmosphere communicating path has a thin communicating path portion at an intermediate position thereof, the thin communicating path portion being thinner than other communicating path portions and being capable of holding a portion of the liquid stored in the liquid storage chamber by a meniscus.

An amount of liquid sufficient for blocking the liquid stored in the liquid storage chamber from the atmospheric air is held in the thin communicating path portion.

In the liquid storage container having the above-described structure, the atmosphere communicating path is liquid-sealed by the liquid held in the thin communicating path portion provided at the intermediate position of the atmosphere communicating path. Therefore, natural ventilation of the atmospheric air in the ink storage chamber does not occur. As a result, moisture included in the liquid stored in the liquid storage chamber is prevented from being evaporated and discharged to the outside through the atmosphere communicating path. Accordingly, viscosity of the liquid can be prevented from being increased due to the evaporation of the moisture.

When the liquid contained in the liquid storage chamber is consumed and the pressure in the liquid storage chamber is reduced, the liquid seal allows the atmospheric air to pass through the liquid forming the liquid seal from the outside in the form of very small air bubbles. Accordingly, the atmospheric air flows into the liquid storage chamber and the pressure in the liquid storage chamber returns to the atmospheric pressure. When the pressure in the liquid storage chamber is not reduced, the atmospheric air is not guided into the liquid storage chamber from the outside. Thus, the amount of atmospheric air that flows into the liquid storage chamber through the atmosphere communicating path is regulated to the minimum necessary amount. Therefore, quality degradation of the liquid due to contact between the liquid and fresh air can be suppressed. As a result, the quality of the liquid stored in the liquid storage chamber can be stably maintained for a long time.

In the liquid storage container having the above-described structure, preferably, an atmospheric air outlet at one end of the thin communicating path portion is positioned near a bottom wall of the liquid storage chamber.

In addition, preferably, an atmospheric air inlet at the other end of the thin communicating path portion is positioned below the bottom wall of the liquid storage chamber.

According to the liquid storage container having the above-described structure, when, for example, a predetermined amount of liquid is injected into the liquid storage chamber in the manufacturing process, a necessary amount of liquid can be supplied to the thin communicating path portion by the liquid pressure applied to the atmospheric air outlet in the liquid storage chamber. Therefore, the liquid seal portion can be easily provided at the intermediate position of the atmosphere communicating path.

In the liquid storage container having the above-described structure, preferably, the thin communicating path portion is substantially L-shaped.

According to the liquid storage container having the above-described structure, a meniscus force is generated at the bent portion of the substantially L-shaped thin communicating path portion. The meniscus force exerts a holding force for restricting the movement of the liquid held in the thin communicating path portion so as to form the liquid seal. Accordingly, the liquid-sealed state in which the liquid is held in the thin communicating portion can be stably maintained.

The above-described object of the present invention can also be achieved by a liquid storage container that is opened to the atmosphere, that is attached to a liquid-consuming apparatus, and that includes: a liquid storage chamber that stores liquid; a liquid-supplying unit connected to the liquid-consuming apparatus; a liquid guide path for guiding the liquid contained in the liquid storage chamber to the liquid-supplying unit; an atmosphere communicating path that allows atmospheric air to flow into the liquid storage chamber from the outside as the liquid in the liquid storage chamber is consumed; and a liquid sensor disposed in the liquid guide path, wherein the atmosphere communicating path has a thin communicating path portion at an intermediate position thereof, the thin communicating path portion being thinner than other communicating path portions and being capable of holding a portion of the liquid stored in the liquid storage chamber by a meniscus.

An amount of liquid sufficient for blocking the liquid stored in the liquid storage chamber from the atmospheric air is held in the thin communicating path portion.

In the liquid storage container having the above-described structure, the atmosphere communicating path is liquid-sealed by the liquid held in the thin communicating path portion provided at the intermediate position of the atmosphere communicating path. Therefore, natural ventilation of the atmospheric air in the ink storage chamber does not occur. As a result, moisture included in the liquid stored in the liquid storage chamber is prevented from being evaporated and discharged to the outside through the atmosphere communicating path. Accordingly, viscosity of the liquid can be prevented from being increased due to the evaporation of the moisture.

DETAILED DESCRIPTION OF THE INVENTION

A liquid storage container according to a preferred embodiment of the present invention will be described in detail below with reference to the drawings. In the embodiment described below, an ink cartridge attached to an inkjet recording apparatus (printer), which is an example of a liquid ejection apparatus, will be explained as an example of a liquid storage container.

Figure 1:
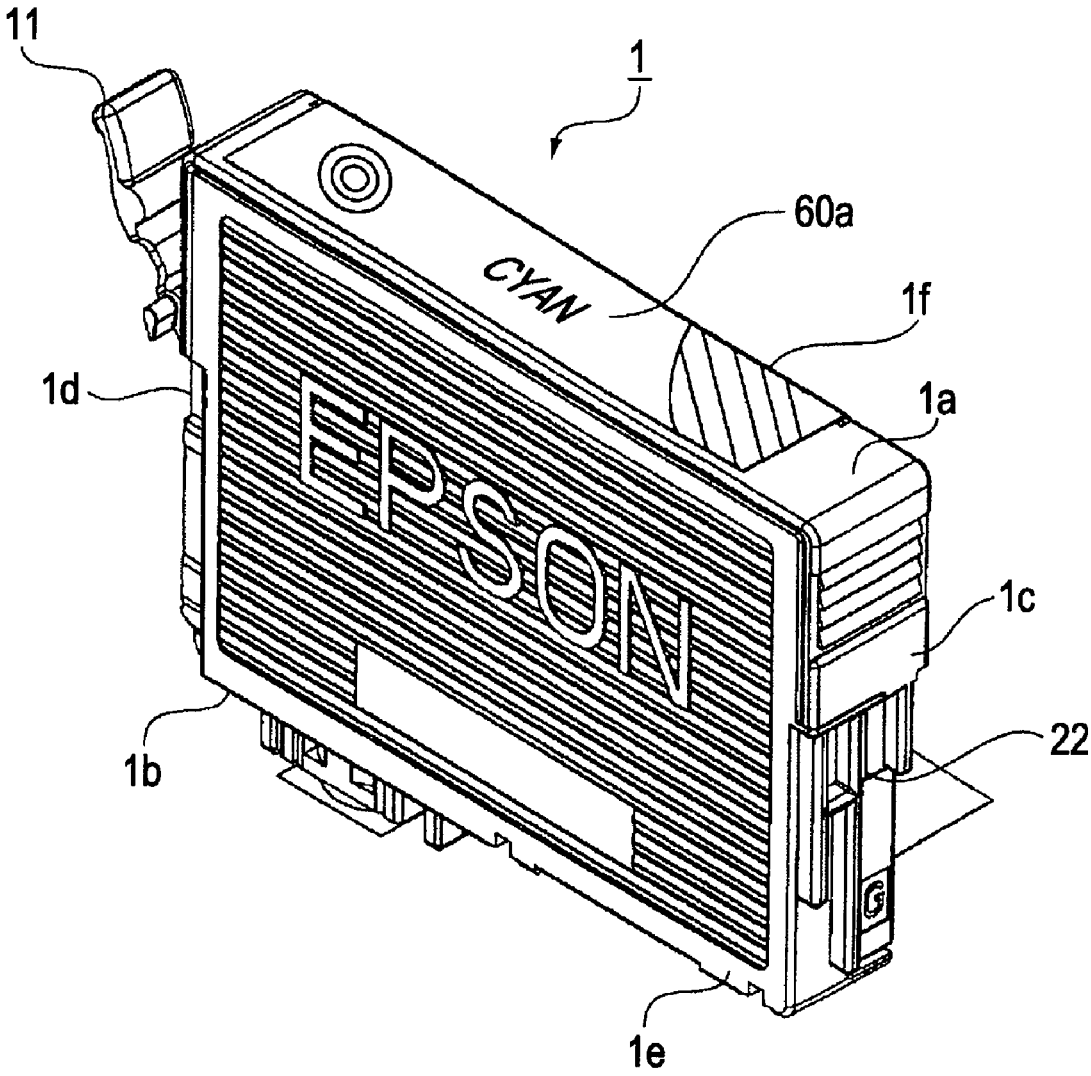
FIG. 1 is an external perspective view illustrating an ink cartridge as a liquid storage container according to an embodiment of the present invention.
Figure 2:
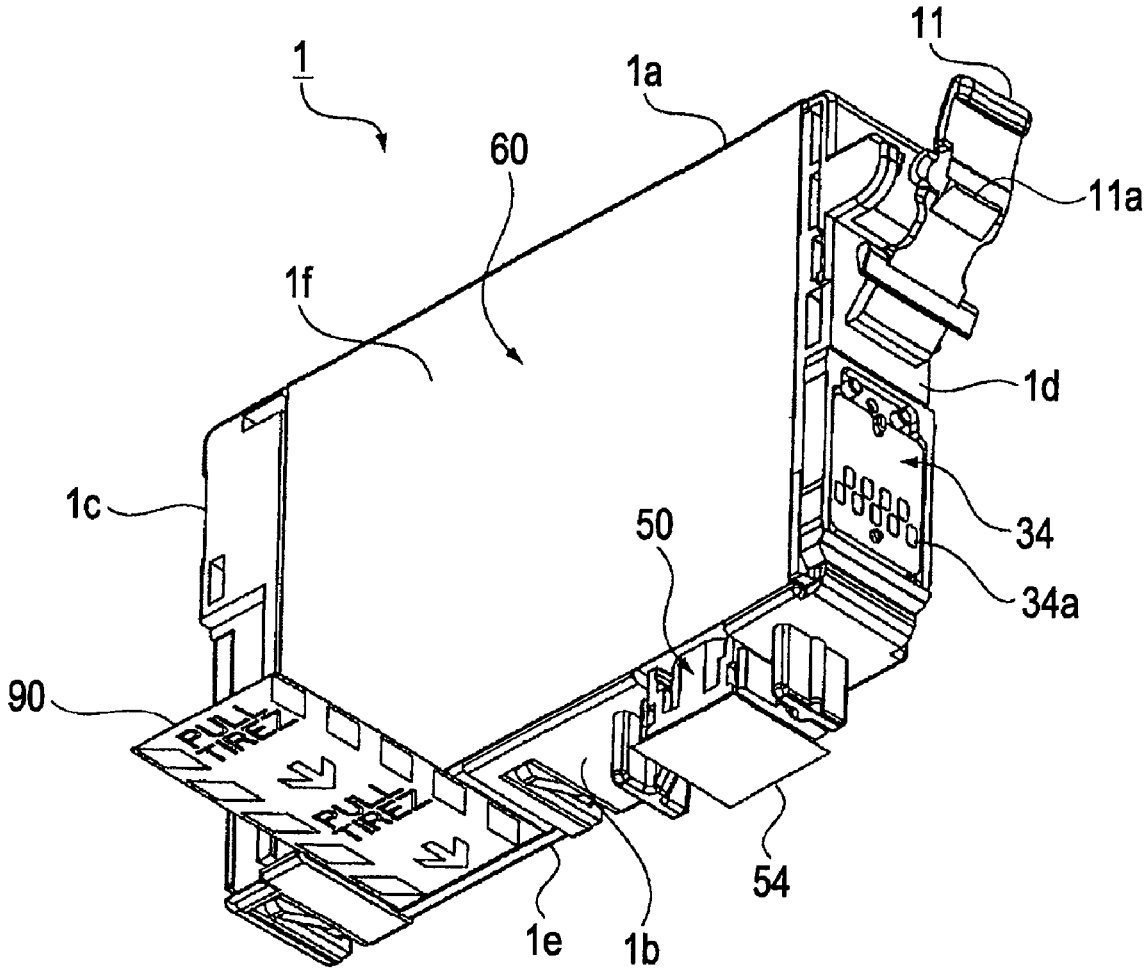
FIG. 2 is an external perspective view of the ink cartridge according to the embodiment of the present invention shown in FIG. 1 as viewed from the opposite angle.
Figure 3:
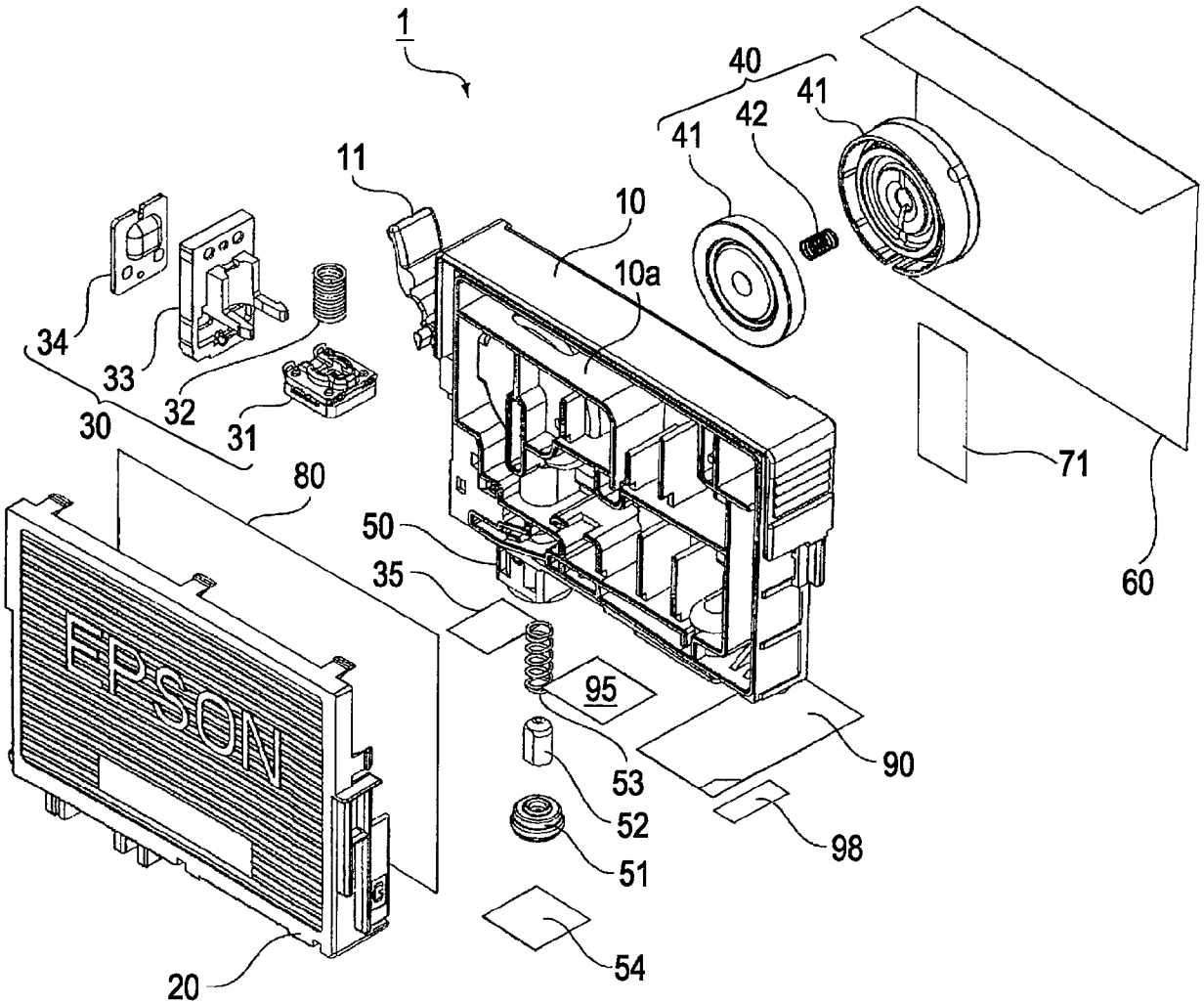
FIG. 3 is an exploded perspective view of the ink cartridge according to the embodiment of the present invention.
Figure 4:
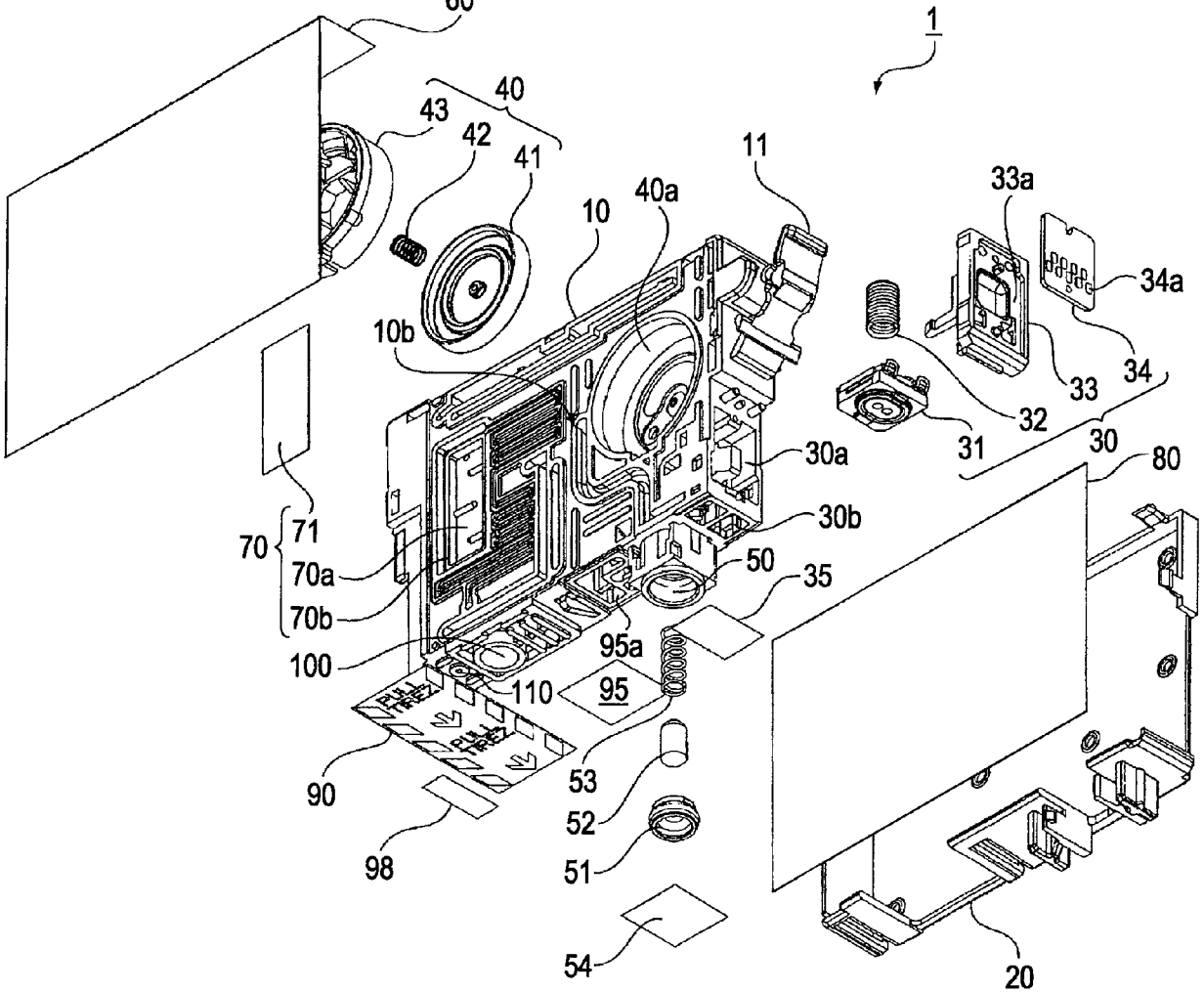
FIG. 4 is an exploded perspective view of the ink cartridge according to the embodiment of the present invention shown in FIG. 3 as viewed from the opposite angle.
Figure 5:
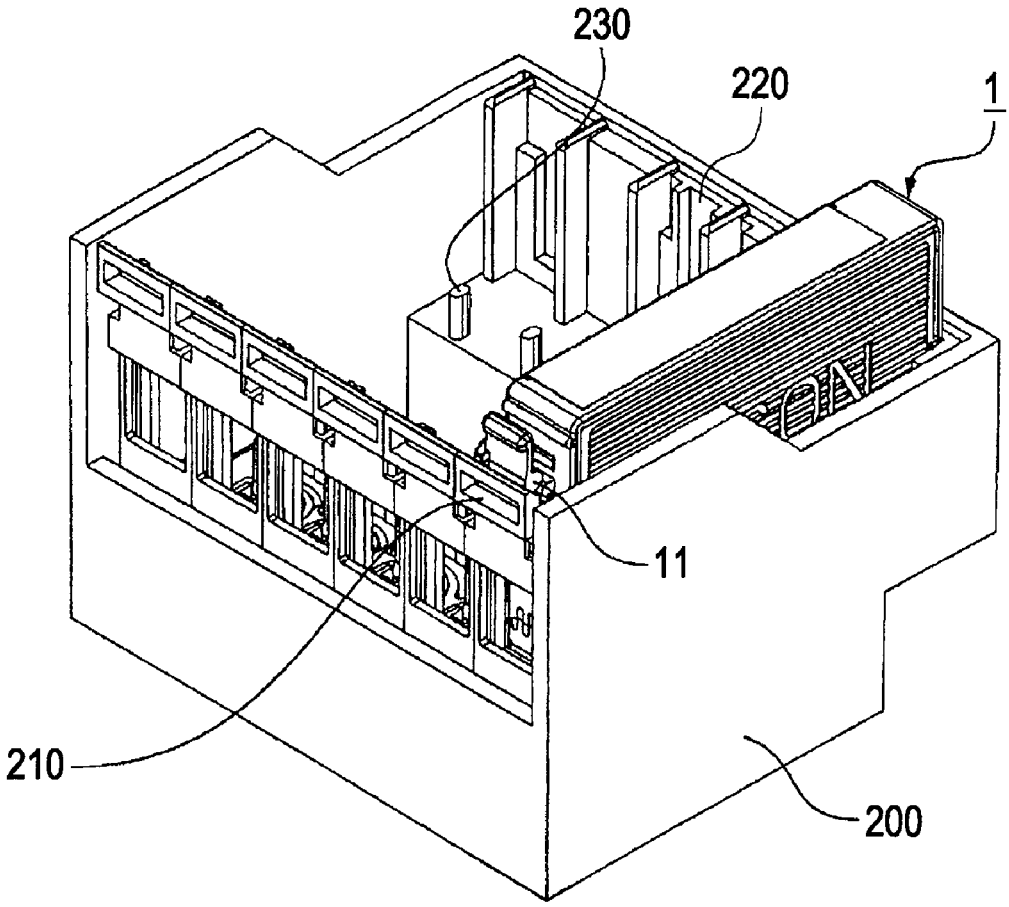
FIG. 5 is a diagram illustrating the state in which the ink cartridge according to the embodiment of the present invention is attached to a carriage of an inkjet recording apparatus.
Figure 6:
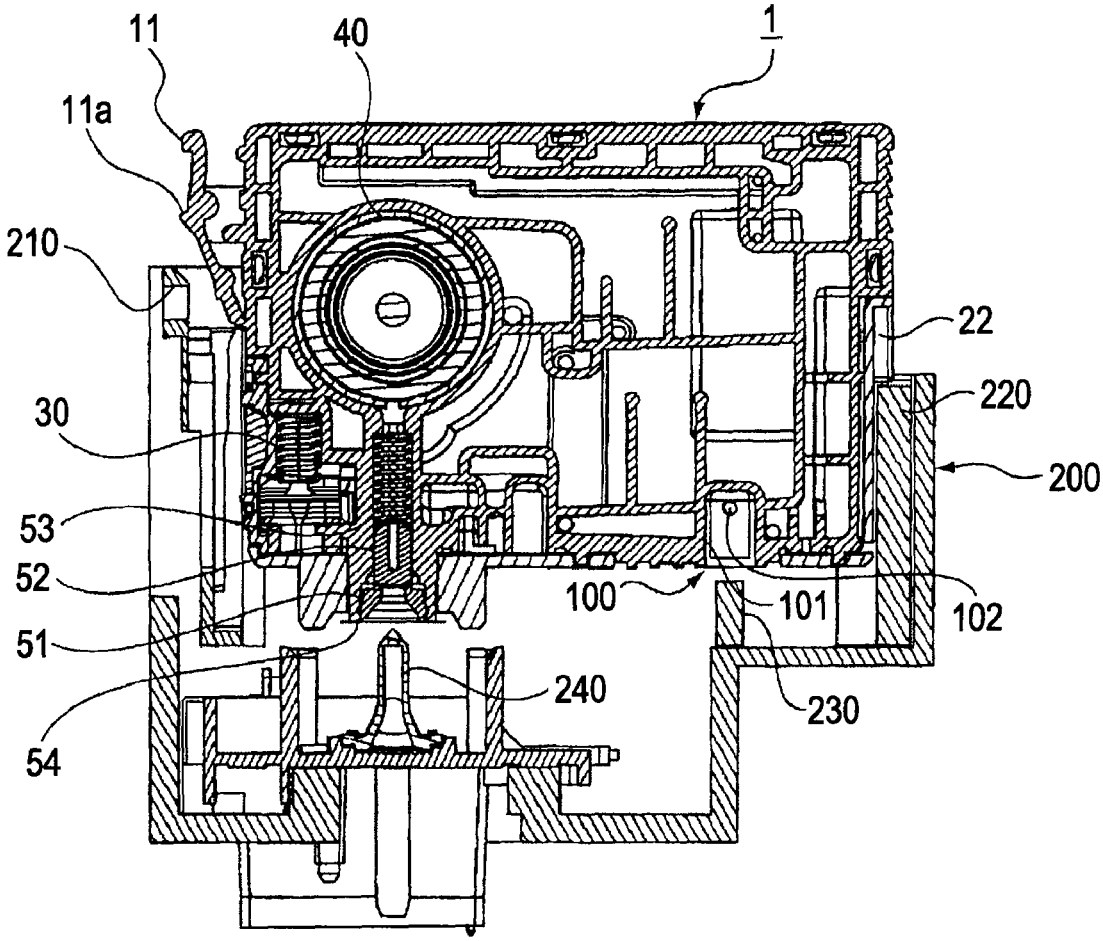
FIG. 6 is a sectional view illustrating the state immediately before the ink cartridge according to the embodiment of the present invention is attached to the carriage.
Figure 7:
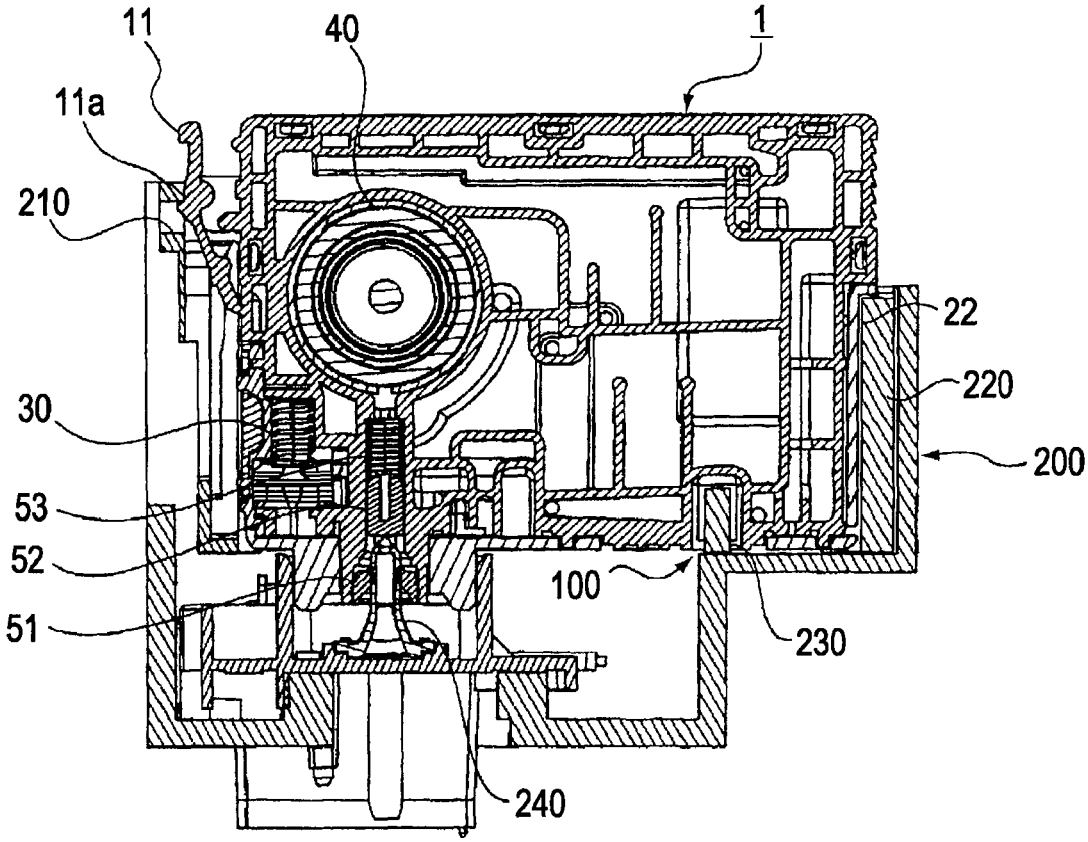
FIG. 7 is a sectional view illustrating the state immediately before the ink cartridge according to the embodiment of the present invention is attached to the carriage.

FIG. 1 is an external perspective view illustrating an ink cartridge as a liquid storage container according to an embodiment of the present invention. FIG. 2 is an external perspective view of the ink cartridge according to the present embodiment shown in FIG. 1 as viewed from the opposite angle. FIG. 3 is an exploded perspective view of the ink cartridge according to the present embodiment. FIG. 4 is an exploded perspective view of the ink cartridge according to the present embodiment shown in FIG. 3 as viewed from the opposite angle. FIG. 5 is a diagram illustrating the state in which the ink cartridge according to the present embodiment is attached to a carriage. FIG. 6 is a sectional view illustrating the state immediately before the attachment to the carriage. FIG. 7 is a sectional view illustrating the state immediately after the attachment to the carriage.

As shown in FIGS. 1 and 2, an ink cartridge 1 according to the present embodiment has a substantially rectangular parallelepiped shape, and functions as a liquid storage container that contains and stores ink (liquid) I in ink storage chambers (liquid storage chambers) provided therein. The ink cartridge 1 is attached to a carriage 200 included in an ink jet recording apparatus, which is an example of a liquid-consuming apparatus, and supplies the ink to the ink jet recording apparatus (see FIG. 5).

Characteristics of the ink cartridge 1 in appearance will be described below. As shown in FIGS. 1 and 2, the ink cartridge 1 has a flat top face 1*a* and a bottom face 1*b* that faces the top face 1*a*. An ink-supplying unit (liquid-supplying unit) 50 that is connected to the ink jet recording apparatus and supplies ink thereto is provided at the bottom face 1*b*. An atmospheric vent 100 for allowing atmospheric air to flow into the ink cartridge 1 is formed in the bottom face 1*b*. Thus, the ink cartridge 1 is opened to the atmosphere and supplies ink through the ink-supplying unit 50 while allowing atmospheric air to flow therein through the atmospheric vent 100.

In the present embodiment, as shown in FIG. 6, the atmospheric vent 100 is defined by a substantially cylindrical recess 101 that extends from the bottom face 1*b* toward the top face and a small hole 102 formed in the inner peripheral surface of the recess 101. The small hole 102 communicates with an atmosphere communicating path, which will be described below, and the atmospheric air flows through the small hole 102 into an upper ink storage chamber 370 disposed at the uppermost stream position, which will also be described below.

The depth of the recess 101 of the atmospheric vent 100 is set such that a projection 230 formed on the carriage 200 can be received by the recess 101. The projection 230 functions a removal-failure-preventing projection for preventing a sealing film 90, which functions as sealing means for sealing the atmospheric vent 100 airtight, from being left unremoved. That is, while the sealing film 90 is adhered so as to cover the atmospheric vent 100, the projection 230 cannot be inserted into the atmospheric vent 100, and therefore the ink cartridge 1 cannot be attached to the carriage 200. Since a user cannot attach the ink cartridge 1 to the carriage 200 as long as the sealing film 90 is adhered so as to cover the atmospheric vent 100, the user can be prompted to remove the sealing film 90 without failure before attaching the ink cartridge 1.

In addition, as shown in FIG. 1, a misinsertion preventing projection 22 for preventing the ink cartridge 1 from being attached at a wrong position is provided at a narrow face 1*c* adjacent to one of the short sides of the top face 1*a* of the ink cartridge 1. As shown in FIG. 5, the carriage 200, which receives the ink cartridge 1, has a recessed pattern 220 that corresponds to the misinsertion preventing projection 22. The ink cartridge 1 can be attached to the carriage 200 only when the misinsertion preventing projection 22 and the recessed pattern 220 do not interfere with each other. The shape of the misinsertion preventing projection 22 is determined in accordance with the kind of the ink, and so is the shape of the recessed pattern 220 in the carriage 200 that receives the ink cartridge 1. Therefore, even when the carriage 200 is capable of receiving a plurality of kinds of ink cartridges, as shown in FIG. 5, the ink cartridges can be prevented from being attached at wrong positions.

In addition, as shown in FIG. 2, an engagement lever 11 is provided on a narrow face 1*d* that faces the narrow face 1*c* of the ink cartridge 1. The engagement lever 11 has a projection 11*a* that engages with a recess 210 formed in the carriage 200 when the ink cartridge 1 is attached to the carriage 200. The engagement lever 11 is bent and thereby allows the projection 11*a* to engage with the recess 210, so that the ink cartridge 1 can be positioned and attached to the carriage 200.

A circuit substrate 34 is provided below the engagement lever 11. A plurality of electrode terminals 34*a* are formed on the circuit substrate 34. The electrode terminals 34*a* come into contact with electrode members (not shown) provided on the carriage 200. Accordingly, the ink cartridge 1 is electrically connected to the ink jet recording apparatus. The circuit substrate 34 has a nonvolatile memory in which data can be rewritten and which stores various information regarding the ink cartridge 1, ink usage information of the ink jet recording apparatus, etc. A liquid remaining-amount sensor (sensor unit) 31 (see FIG. 3 or FIG. 4) for detecting the amount of ink remaining in the ink cartridge 1 by utilizing residual vibration is provided behind the circuit substrate 34. In the following description, the unit including the liquid remaining-amount sensor 31 and the circuit substrate 34 is sometimes called an ink end sensor 30.

As shown in FIG. 1, a label 60*a* indicating the content of the ink cartridge is adhered to the top face 1*a* of the ink cartridge 1. The label 60*a* is formed as an end portion of an outer surface film 60 that extends so as to cover both a broad face 1*f* and the top face 1*a*.

As shown in FIGS. 1 and 2, broad faces 1*e* and 1*f* that are respectively adjacent to the two long sides of the top face 1*a* of the ink cartridge 1 are both flat. In the following description, for convenience of explanation, the broad face 1*e*, the broad face 1*f*, the narrow face 1*c*, and the narrow face 1*d* will be called front, back, right, and left sides, respectively.

Next, each component of the ink cartridge 1 will be described below with reference to FIGS. 3 and 4.

The ink cartridge 1 includes a cartridge main body 10 that functions as a container main body and a lid member 20 that covers the front side of the cartridge main body 10.

The cartridge main body 10 includes ribs 10*a* having various shapes on the front side thereof. The ribs 10*a* function as partition walls for dividing the inner space into a plurality of ink storage chambers (liquid storage chambers) that are filled with ink 1, an ink-free chamber that is free from the ink 1, and air chambers disposed at intermediate positions of an atmosphere communicating path 150, which will be described below.

A film 80 that covers the front side of the cartridge main body 10 is disposed between the cartridge main body 10 and the lid member 20. The film 80 seals the top sides of the ribs, recesses, and grooves so as to define a plurality of flow paths, the ink storage chambers, the ink-free chamber, and the air chambers.

A differential-pressure-regulating-valve storage chamber 40*a*, which functions as a recess for receiving a differential pressure regulating valve 40, and a gas-liquid separation chamber 70*a*, which functions as a recess for receiving a gas-liquid separation filter 70, are formed at the back side of the cartridge main body 10.

The differential-pressure-regulating-valve storage chamber 40*a* receive the differential pressure regulating valve 40 which includes a valve member 41, a spring 42, and a spring washer 43. The differential pressure regulating valve 40 is positioned between the ink-supplying unit 50 disposed at a downstream position and the ink storage chambers disposed at upstream positions. The differential pressure regulating valve 40 reduces a downstream pressure relative to an upstream pressure, so that the ink 1 supplied to the ink-supplying unit 50 has a negative pressure.

A bank 70*b* is provided at a central region of the gas-liquid separation chamber 70*a* so as to extend along the outer periphery thereof, and a gas-liquid separation film 71 is adhered to the top side of the gas-liquid separation chamber 70*a* along the bank 70*b*. The gas-liquid separation film 71 blocks liquid while allowing gas to pass therethrough, and the overall structure functions as the gas-liquid separation filter 70. The gas-liquid separation filter 70 is disposed in the atmosphere communicating path 150 that connects the atmospheric vent 100 to the ink storage chambers and prevents the ink 1 in the ink storage chambers from flowing out of the atmospheric vent 100 through the atmosphere communicating path 150.

In addition to the differential-pressure-regulating-valve storage chamber 40*a* and the gas-liquid separation chamber 70*a*, a plurality of grooves 10*b* are formed in the back side of the cartridge main body 10. The outer surface film 60 covers the grooves 10*b* in a state such that the differential pressure regulating valve 40 and the gas-liquid separation filter 70 are installed. Accordingly, the open sides of the grooves 10*b* are closed so as to form the atmosphere communicating path 150 and ink guide paths.

As shown in FIG. 4, a sensor chamber 30*a* which functions as a recess for receiving members included in the ink end sensor 30 is formed in the right side of the cartridge main body 10. The sensor chamber 30*a* receives the liquid remaining-amount sensor 31 and a compression spring 32 that fixes the liquid remaining-amount sensor 31 by pressing the liquid remaining-amount sensor 31 against an inner wall of the sensor chamber 30*a*. The open side of the sensor chamber 30*a* is covered with a cover member 33, and the circuit substrate 34 is fixed to an outer surface 33*a* of the cover member 33. Sensing elements included in the liquid remaining-amount sensor 31 are connected to the circuit substrate 34.

The liquid remaining-amount sensor 31 includes a cavity that functions as a portion of an ink guide path extending between the ink-supplying unit 50 and the ink storage chambers, a vibration plate that defines a portion of a wall surface of the cavity, and a piezoelectric element (piezoelectric actuator) for causing the vibration plate to vibrate. The liquid remaining-amount sensor 31 detects the presence/absence of the ink 1 in the ink guide path on the basis of residual vibration obtained when the vibration plate is vibrated. The liquid remaining-amount sensor 31 detects a difference in the amplitude, frequency, etc., of the residual vibration between the ink 1 and gas (air bubbles B mixed in the ink), thereby determining the presence/absence of the ink 1 in the cartridge main body 10.

More specifically, when the ink contained in the ink storage chambers of the cartridge main body 10 runs out and the atmospheric air that flows into the ink storage chambers travels through the ink guide path and enters the cavity of the liquid remaining-amount sensor 31, such a state is detected from a change in the amplitude or the frequency of the residual vibration. Accordingly, an electrical signal indicating that the ink has run out is output.

In addition to the above-described ink-supplying unit 50 and the atmospheric vent 100, as shown in FIG. 4, a pressure reducing hole 110, a recess 95*a*, and a buffer chamber 30*b* are formed in the bottom side of the cartridge main body 10. The pressure reducing hole 110 is used for reducing the pressure by sucking out the air from the ink cartridge 1 using vacuuming means when the ink is injected. The recess 95*a* defines the ink guide path that extends from the ink storage chambers to the ink-supplying unit 50. The buffer chamber 30*b* is disposed under the ink end sensor 30.

Open sides of the ink-supplying unit 50, the atmospheric vent 100, the pressure reducing hole 110, the recess 95*a*, and the buffer chamber 30*b* are sealed by sealing films 54, 90, 98, 95, and 35, respectively, immediately after the ink cartridge is manufactured. The sealing film 90 that seals the atmospheric vent 100 is removed by the user when the ink cartridge is attached to the ink jet recording apparatus for use. Accordingly, the atmospheric vent 100 is exposed and the ink storage chambers in the ink cartridge 1 communicate with the atmosphere via the atmosphere communicating path 150.

As shown in FIGS. 6 and 7, when the ink cartridge is attached to the ink jet recording apparatus, an ink supply needle 240 provided in the ink jet recording apparatus breaks the sealing film 35 adhered to the outer surface of the ink-supplying unit 50.

As shown in FIGS. 6 and 7, the ink-supplying unit 50 includes an annular seal member 51 that is pressed against the outer surface of the ink supply needle 240 when the ink cartridge is attached, a spring washer 52 that is in contact with the seal member 51 so as to close the ink-supplying unit 50 while the ink cartridge is not attached to the printer, and a compression spring 53 for urging the spring washer 52 toward the seal member 51.

As shown in FIGS. 6 and 7, when the ink supply needle 240 is inserted into the ink-supplying unit 50, the space between the inner periphery of the seal member 51 and the outer periphery of the ink supply needle 240 are sealed so that the gap between the ink-supplying unit 50 and the ink supply needle 240 are sealed liquid-tight. In addition, a tip portion of the ink supply needle 51 comes into contact with the spring washer 52 and pushes the spring washer 52 upward, so that the spring washer 52 is removed from the seal member 51. Accordingly, the ink can be supplied from the ink-supplying unit 50 to the ink supply needle 240.

The inner structure of the ink cartridge 1 according to the present embodiment will be described below with reference to FIGS. 8 to 12.

Figure 8:
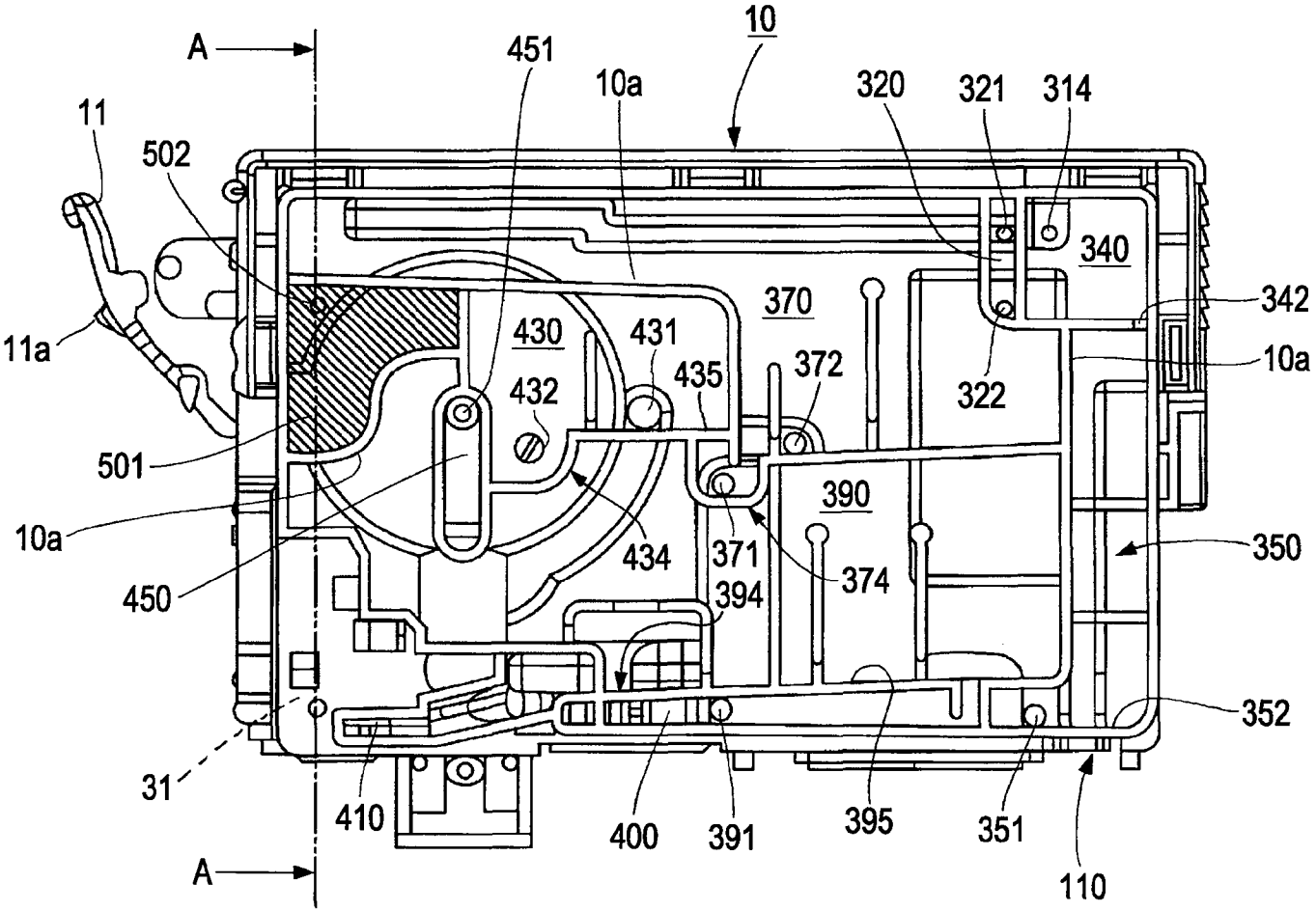
FIG. 8 is a front view of a cartridge main body of the ink cartridge according to the embodiment of the present invention.
Figure 9:
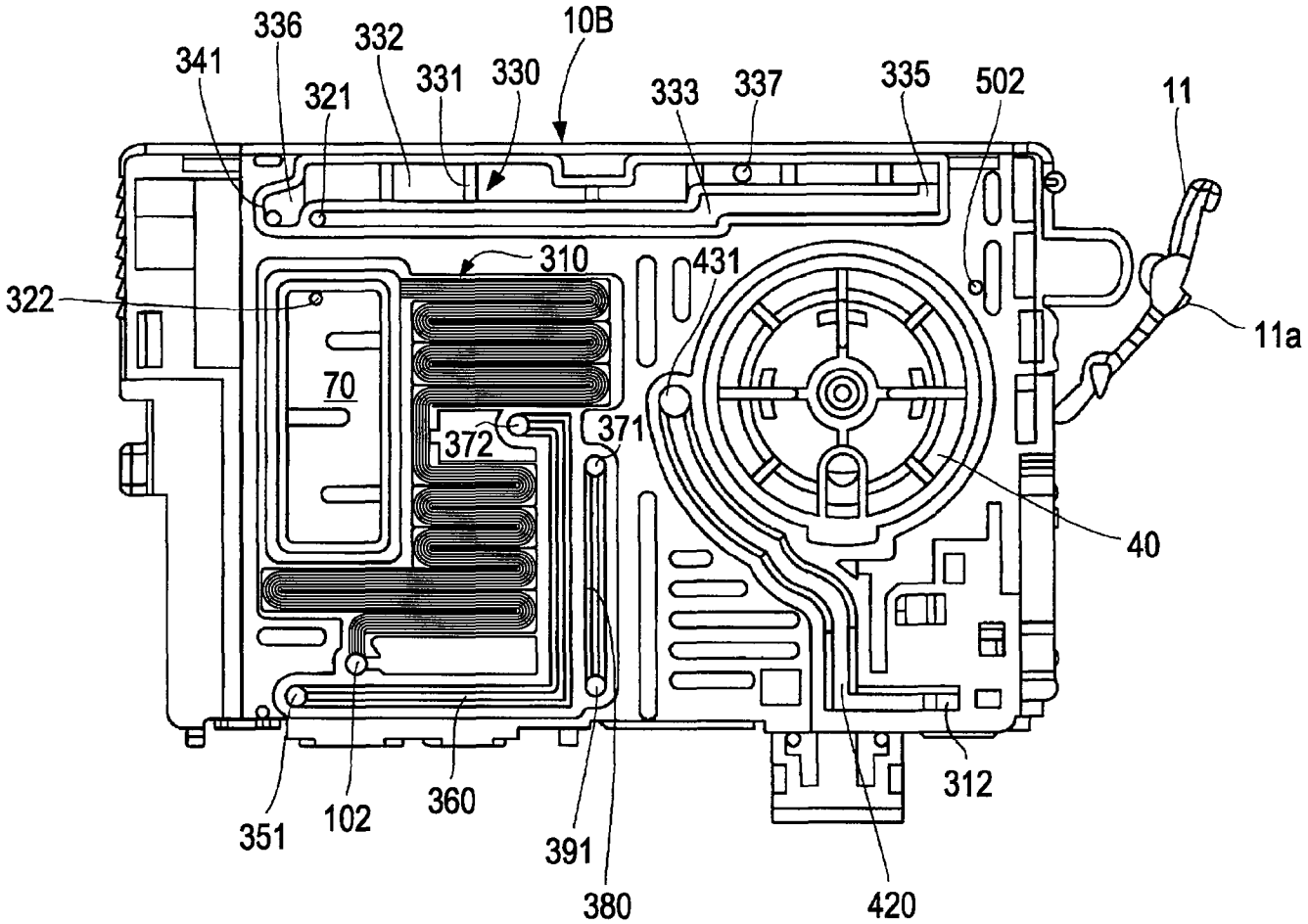
FIG. 9 is a rear view of a cartridge main body of the ink cartridge according to the embodiment of the present invention.
Figure 10:
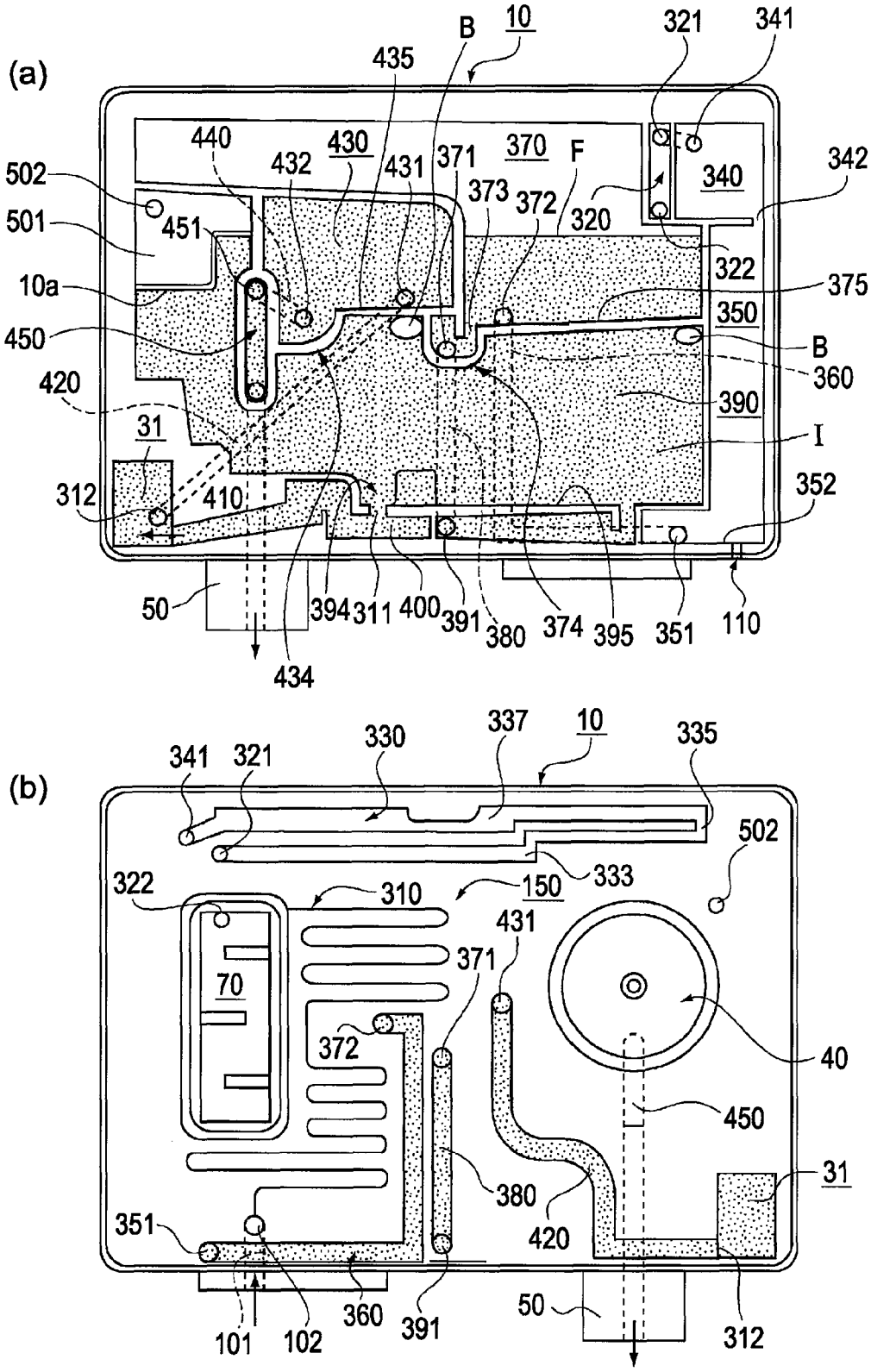
FIG. 10(*a*) is a simplified diagram of the structure shown in FIG. 8, and FIG. 10(*b*) is a simplified diagram of the structure shown in FIG. 9.
Figure 11:
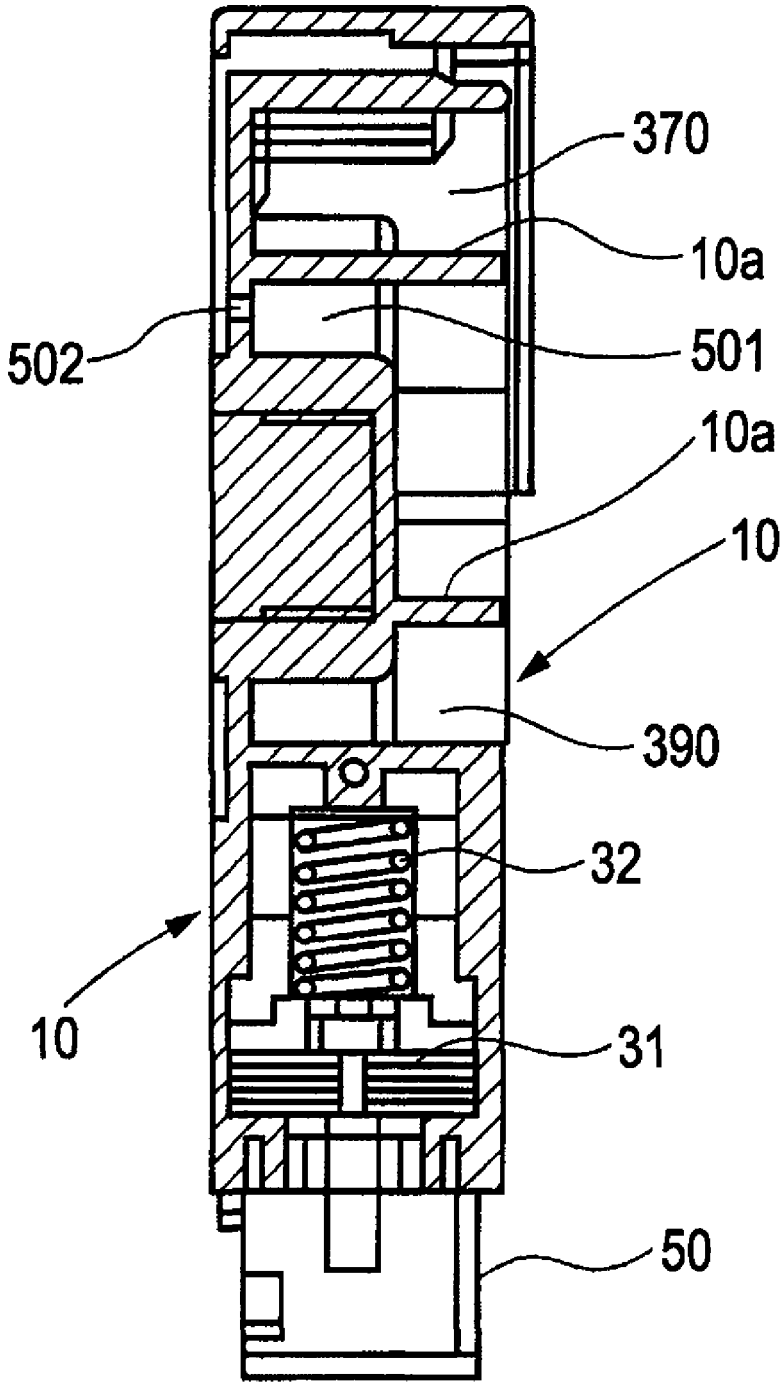
FIG. 11 is a sectional view of FIG. 8 taken along line A-A.
Figure 12:
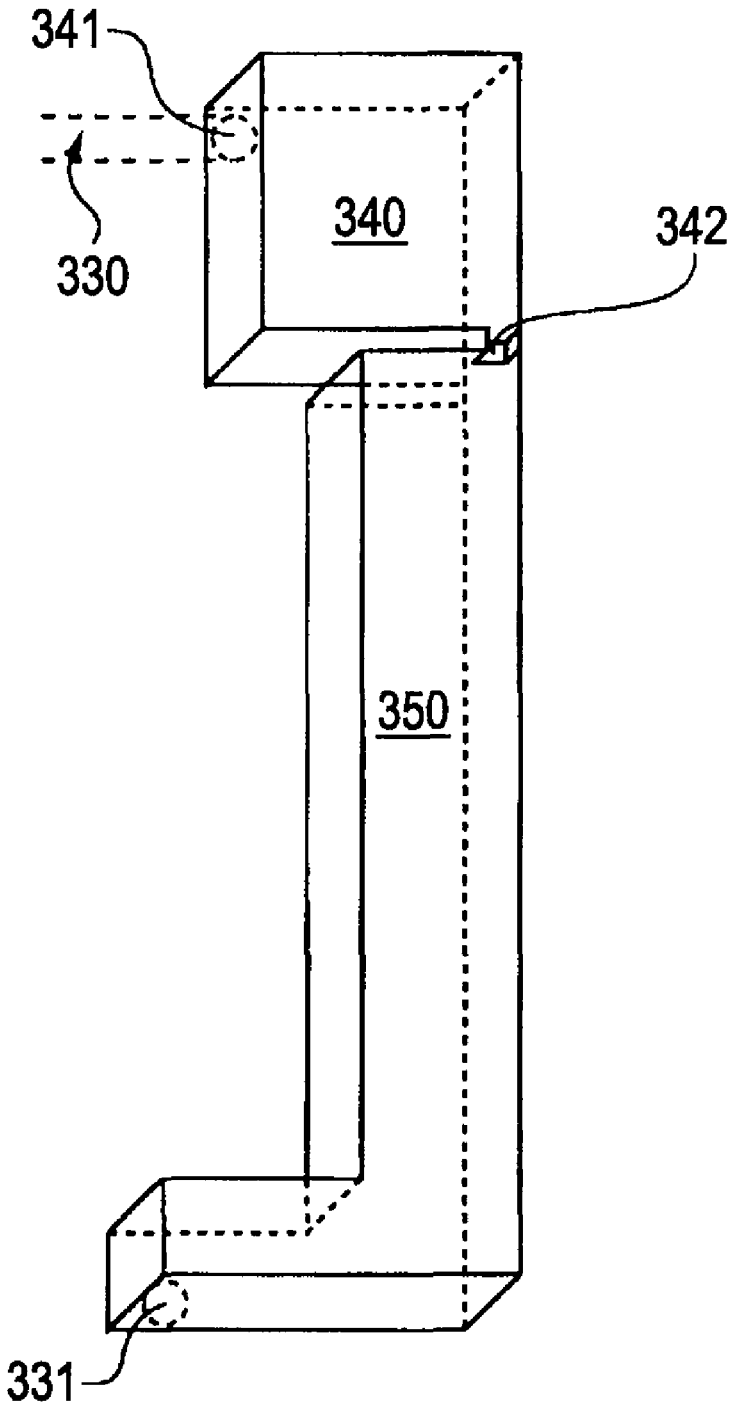
FIG. 12 is an enlarged perspective view of a portion of a flow path structure in the cartridge main body shown in FIG. 8.

FIG. 8 is a front view of the cartridge main body 10 of the ink cartridge 1 according to the present embodiment. FIG. 9 is a rear view of the cartridge main body 10 of the ink cartridge 1 according to the present embodiment. FIG. 10(*a*) is a simplified diagram of the structure shown in FIG. 8, and FIG. 10(*b*) is a simplified diagram of the structure shown in FIG. 9. FIG. 11 is a sectional view of FIG. 8 taken along line A-A. FIG. 12 is an enlarged perspective view of a flow path shown in FIG. 8.

In the ink cartridge 11 according to the present embodiment, three ink storage chambers in which the ink 1 is contained are provided at the front side of the cartridge main body 10. The three ink storage chambers include the upper ink storage chamber 370 and a lower ink storage chamber 390 that are separated from each other in the vertical direction, and a buffer chamber 430 that is positioned between the upper and lower ink storage chambers (see FIG. 10).

In addition, the atmosphere communicating path 150 for allowing the atmospheric air to flow into the upper ink storage chamber 370, which is at the most upstream position, in accordance with the amount of consumption of the ink 1 is provided at the back side of the cartridge main body 10.

The ink storage chambers 370 and 390 and the buffer chamber 430 are sectioned from each other by the ribs 10*a*. In the present embodiment, these ink storage chambers have concavities 374, 394, and 434 formed so as to dent downward in the ribs 10*a* that extend horizontally to define the bottom walls of the storage chambers.

The concavity 374 is formed by denting a portion of the rib 10*a* that forms a bottom wall 375 of the upper ink storage chamber 370 downward. The concavity 394 is formed so as to dent in the thickness direction of the cartridge by the rib 10*a* that forms a bottom wall 395 of the lower ink storage chamber 390 and a swelling portion of a wall surface. The concavity 434 is formed by denting a portion of the rib 10*a* that forms a bottom wall 435 of the buffer chamber 430 downward.

Ink outlets 371, 311, and 432 that communicate with an ink guide path 380, an upstream ink-end-sensor connecting flow path 400, and an ink guide path 440, respectively, are provided at or near the concavities 374, 394, and 434, respectively.

The ink outlets 371 and 432 are through holes that extend through the walls of the corresponding ink storage chambers in the thickness direction of the cartridge main body 10. The ink outlet 311 is a through hole that extends downward through the bottom wall 395.

The ink guide path 380 communicates with the ink outlet 371 of the upper ink storage chamber 370 at one end thereof and with an ink inlet 391 formed in the lower ink storage chamber 390 at the other end thereof. The ink guide path 380 functions as a communicating flow path that guides the ink 1 from the upper ink storage chamber 370 to the lower ink storage chamber 390. The ink guide path 380 is formed so as to extend vertically downward from the ink outlet 371 of the upper ink storage chamber 370, and thereby provides a descending connection between the liquid storage chambers 370 and 390 so that the ink 1 descends downward through the communicating flow path.

An ink guide path 420 is connected to an ink outlet 312 provided in the cavity of the liquid remaining-amount sensor 31 disposed downstream of the lower ink storage chamber 390 at one end thereof, and to an ink inlet 431 provided in the buffer chamber 430 at the other end thereof. The ink guide path 420 guides the ink 1 from the lower ink storage chamber 390 to the buffer chamber 430. The guide path 420 extends obliquely upward from the ink outlet 312 formed in the cavity of the liquid remaining-amount sensor 31, and thereby provides an ascending connection between the ink storage chambers 390 and 430 so that the ink 1 ascends upward through the communicating flow path.

Thus, in the cartridge main body 10 according to the present invention, the descending connection and the ascending connection are alternately provided to connect the three ink storage chambers 370, 390, and 430.

The ink guide path 440 guides the ink from the ink outlet 432 of the buffer chamber 430 to the differential pressure regulating valve 40.

According to the present embodiment, the ink inlets 391 and 431 of the ink storage chambers are respectively positioned above the ink outlets 371 and 311 formed in the corresponding storage chambers and near the bottom walls 375, 395, and 435 of the corresponding ink storage chambers.

The ink guide paths for guiding the ink from the upper ink storage chamber 370, which is a main ink storage chamber, to the ink-supplying unit 50 will be described below with reference to FIGS. 8 to 12.

The upper ink storage chamber 370 is positioned at the most upstream (uppermost) position in the cartridge main body 10, and is disposed at the front side of the cartridge main body 10, as shown in FIG. 8. The upper ink storage chamber 370 has a capacity of about half of the total capacity of the ink storage chambers, and occupies substantially an upper half section of the cartridge main body 10.

The ink outlet 371 that communicates with the ink guide path 380 is formed in the concavity 374 of the bottom wall 375 of the upper ink storage chamber 370. The ink outlet 371 is positioned below the bottom wall 375 of the upper ink storage chamber 370. Therefore, even when the ink surface F in the upper ink storage chamber 370 becomes lower and reaches the bottom wall 375, the ink outlet 371 is still below the ink surface F and continues to stably eject the ink 1.

As shown in FIG. 9, the ink guide path 380 is disposed at the back side of the cartridge main body 10 and guides the ink 1 downward to the lower ink storage chamber 390.

The ink 1 contained in the upper ink storage chamber 370 is guided to the lower ink storage chamber 390. As shown in FIG. 8, the lower ink storage chamber 390 is disposed at the front side of the cartridge main body 10 and has a capacity of about half of the total capacity of the ink storage chambers. The lower ink storage chamber 390 occupies a lower half section of the cartridge main body 10.

The ink inlet 391, which communicates with the ink guide path 380, opens into a communicating flow path disposed under the bottom wall 395 of the lower ink storage chamber 390. The ink 1 from the upper ink storage chamber 370 flows into the lower ink storage chamber 390 through the communicating flow path.

The lower ink storage chamber 390 communicates with the upstream ink-end-sensor connecting flow path 400 through the ink outlet 311 that extends through the bottom wall 395. The upstream ink-end-sensor connecting flow path 400 includes a maze-like flow path having a three-dimensional structure for catching the air bubbles B and the like that flow into the maze-like flow path before the ink runs out so as to prevent the air bubbles B and the like from flowing downstream.

The upstream ink-end-sensor connecting flow path 400 communicates with a downstream ink-end-sensor connecting flow path 410 via a through hole (not shown), and the ink 1 is guided to the liquid remaining-amount sensor 31 through the downstream ink-end-sensor connecting flow path 410.

The ink 1 guided to the liquid remaining-amount sensor 31 passes through the cavity (flow path) in the liquid remaining-amount sensor 31, and is guided to the ink guide path 420, which is disposed at the back side of the cartridge main body 10, through the ink outlet 312 formed in the cavity.

The ink guide path 420 is formed so as to guide the ink 1 obliquely upward from the liquid remaining-amount sensor 31, and is connected to the ink inlet 431 that communicates with the buffer chamber 430. Accordingly, the ink 1 from the liquid remaining-amount sensor 31 is guided to the buffer chamber 430 through the ink guide path 420.

The buffer chamber 430 is a small cell defined by the ribs 10*a* at a position between the upper ink storage chamber 370 and the lower ink storage chamber 390. The buffer chamber 430 functions as a space in which the ink is stored immediately before reaching the differential pressure regulating valve 40. The buffer chamber 430 is formed so as to face the back side of the differential pressure regulating valve 40. The ink 1 flows into the differential pressure regulating valve 40 through the ink guide path 440 that communicates with the ink outlet 432 formed in the concavity 434 of the buffer chamber 430.

The ink 1 that flows into the differential pressure regulating valve 40 is guided downstream by the differential pressure regulating valve 40 to an outlet flow path 450 through a through hole 451. The outlet flow path 450 communicates with the ink-supplying unit 50. The ink 1 is supplied to the ink jet recording apparatus through the ink supply needle 240 inserted into the ink-supplying unit 50.

In the ink cartridge 1 according to the present embodiment, as shown in FIG. 8, in addition to the above-described ink storage chambers (the upper ink storage chamber 370, the lower ink storage chamber 390, and the buffer chamber 430), the air chambers (the ink trap chamber 340 and the connecting buffer chamber 350), and the ink guide paths (the upstream ink-end-sensor connecting flow path 400 and the downstream ink-end-sensor connecting flow path 410), an ink-free chamber 501 that is free from the ink 1 is also provided at the front side of the cartridge main body 10.

The ink-free chamber 501 is shown as a hatched area near the left side, and is formed between the upper ink storage chamber 370 and the lower ink storage chamber 390 at the front side of the cartridge main body 10.

The ink-free chamber 501 has an atmospheric vent 502 that extends through a back wall thereof at an upper left corner of the inner space, and communicates with the atmosphere through the atmospheric vent 502.

The ink-free chamber 501 functions as a deaerating chamber that accumulates negative pressure for deaerating in the process of vacuum-packaging the cartridge 1. Before use, the pressure in the cartridge main body 10 is maintained equal to or below a predetermined pressure due to the ink-free chamber 501 and the negative-pressure suction force applied in the vacuum packaging process. Accordingly, the ink 1 with a small amount of dissolved air can be provided.

Next, the atmosphere communicating path 150 extending from the atmospheric vent 100 to the upper ink storage chamber 370 will be described below with reference to FIGS. 8 to 12.

When the ink contained in the ink cartridge 11 is consumed and the pressure in the ink cartridge 11 is reduced, the atmospheric air (air) flows into the upper ink storage chamber 370 through the atmospheric vent 100 by an amount corresponding to the amount of reduction of the ink 1.

The small hole 102 formed in the atmospheric vent 100 communicates with a meandering path 310 provided at the back side of the cartridge main body 10 at one end thereof. The meandering path 310 is formed so as to increase the distance from the atmospheric vent 100 to the upper ink storage chamber 370 and has an elongate shape so as to suppress the evaporation of moisture in the ink. The other end of the meandering path 310 is connected to the gas-liquid separation filter 70.

The gas-liquid separation chamber 70*a* included in the gas-liquid separation filter 70 has a through hole 322 in the bottom surface thereof, and communicates with a space 320 provided at the front side of the cartridge main body 10 through the through hole 322.

In the gas-liquid separation filter 70, the gas-liquid separation film 71 is disposed between the through hole 322 and the other end of the meandering path 310. The gas-liquid separation film 71 is made of a mesh webbing made of a textile material having high water repellency and oil repellency.

The space 320 is provided at an upper right section of the upper ink storage chamber 370 when viewed from the front of the cartridge main body 10. In the space 320, a through hole 321 is formed above the through hole 322. The space 320 communicates with an upper connecting flow path 330 formed at the back side through the through hole 321.

The upper connecting flow path 330 extends through a section adjacent to the top surface of the ink cartridge 11, that is, through an uppermost section in the direction of gravity when the ink cartridge 11 is in the attached state. The upper connecting flow path 330 includes flow-path portions 333 and 337. The flow-path portion 333 extends rightward from the through hole 321 along the long side when viewed from the back side. The flow-path portion 337 extends above the flow-path portion 333 from a bent portion 335 positioned near a short side to a through hole 341 formed at a position near the through hole 321. The through hole 341 communicates with an ink trap chamber 340 formed at the front side.

When the upper connecting flow path 330 is viewed from the back, the flow-path portion 337, which extends from the bent portion 335 to the through hole 341, has a position 336 at which the through hole 341 is formed and a recess 332 that is deeper than the position 336 in the cartridge thickness direction. A plurality of ribs 331 are formed so as to divide the recess 332. The flow-path portion 333 that extends from the through hole 321 to the bent portion 335 is shallower than the flow-path portion 337 that extends from the bent portion 335 to the through hole 341.

According to the present embodiment, the upper connecting flow path 330 is provided at the uppermost section in the direction of gravity. Therefore, basically, the ink 1 is prevented from reaching the atmospheric vent 100 through the upper connecting flow path 330. In addition, the upper connecting flow path 330 is thick enough to prevent the backflow of the ink 1 caused by the capillary phenomenon. In addition, since the recess 332 is formed in the flow-path portion 337, the ink 1 that flows backward can be easily caught.

The ink trap chamber 340 is a rectangular parallelepiped space formed at an upper right corner of the cartridge main body 10 when viewed from the front. As shown in FIG. 12, the through hole 341 is formed at a position near the upper left back corner of the ink trap chamber 340 when viewed from the front. In addition, a notch portion 342 is formed in the rib 10*a* that functions as a separation wall at the lower right front corner of the ink trap chamber 340. Thus, the ink trap chamber 340 communicates with a connecting buffer chamber 350 through the notch portion 342.

The ink trap chamber 340 and the connecting buffer chamber 350 are air chambers obtained by partially increasing the volume of the atmosphere communicating path 150 at intermediate positions thereof. Even if the ink 1 flows backward from the upper ink storage chamber 370 for some reason, the ink 1 can be trapped in the ink trap chamber 340 and the connecting buffer chamber 350 and be prevented from flowing further toward the atmospheric vent 100. The detailed roles of the ink trap chamber 340 and the connecting buffer chamber 350 will be described below.

The connecting buffer chamber 350 is a space provided below the ink trap chamber 340. The pressure reducing hole 110 for removing the air in the process of injecting the ink is provided in a bottom surface 352 of the connecting buffer chamber 350. In addition, a through hole 351 that extends in the thickness direction is formed at a position near the bottom surface 352, that is, at a lowermost position in the direction of gravity in the state in which the ink cartridge is attached to the ink jet recording apparatus. The connecting buffer chamber 350 communicates with a thin communicating path 360 provided at the back side through the through hole 351.

The thin communicating path 360 is formed as a portion of the atmosphere communicating path 150 through which the upper ink storage chamber 370 communicates with the atmospheric vent 100. As shown in FIG. 10(*b*), the thin communicating path 360 extends upward in a central region when viewed from the back, and communicates with the upper ink storage chamber 370 through a through hole 372 formed at a position near the bottom wall of the upper ink storage chamber 370.

The through hole 372 at one end of the thin communicating path 360 functions as an atmosphere outlet through which the atmospheric air flows into the upper ink storage chamber 370 from the atmosphere communicating path 150. The through hole 351 at the other end of the thin communicating path 360 communicates with the connecting buffer chamber 350 and functions as an atmosphere inlet through which the atmospheric air flows into the thin communicating path 360 from the connecting buffer chamber 350.

In the thin communicating path 360 according to the present embodiment, the through hole 372 at one end that functions as the atmosphere outlet is positioned near the bottom wall 375 (see FIG. 10(*a*)) of the upper ink storage chamber 370 at the most upstream position. The through hole 371 at the other end that functions as the atmosphere inlet is disposed at a position lower than the bottom wall 375 of the upper ink storage chamber 370 by a distance H1.

As shown in FIG. 10(*b*), the thin communicating path 360 is substantially L-shaped and includes a first communicating path 361 and a second communicating path 362. The first communicating path 361 extends substantially vertically downward from the through hole 372, which functions as the atmosphere outlet, by the distance H1. The second communicating path 362 extends substantially horizontally from the bottom end of the first communicating path 361 by a distance L1 and communicates with the through hole 351 which functions as the atmosphere inlet.

The substantially L-shaped thin communicating path 360 including the first communicating path 361 and the second communicating path 362 has a cross section that is smaller than that of other portions of the atmosphere communicating path 150. Accordingly, the thin communicating path 360 holds a portion of the ink 1 stored in the upper ink storage chamber 370 in the first communicating path 361 and the second communicating path 362 by a meniscus.

The entire body of the thin communicating path 360 is thin enough to form a meniscus. Therefore, even when the air in the upper ink storage chamber 370 expands or contracts due to temperature variation or the like and the liquid surface formed in the thin communicating path 360 is moved, a meniscus can be formed at some position in the thin communicating path 360.

The length H1 of the first communicating path 361 and the length L1 of the second communicating path 362 are set such that the amount of ink held in the thin communicating path 360 is suitable for blocking the ink 1 contained in the upper ink storage chamber 370, etc., from the atmospheric air.

In the above-described ink cartridge 1, the atmosphere communicating path 150 is liquid-sealed by the ink 1 held in the thin communicating path 360 provided at the intermediate position of the atmosphere communicating path 150. Therefore, moisture included in the ink 1 stored in the upper ink storage chamber 370, etc., is prevented from being evaporated and discharged to the outside through the atmosphere communicating path 150. Accordingly, viscosity of the ink 1 can be prevented from being increased due to the evaporation of the moisture.

When the ink 1 contained in the upper ink storage chamber 370 is consumed and the pressure in the upper ink storage chamber 370 is reduced, the liquid seal provided by the thin communicating path 360 allows the atmospheric air to pass through the ink forming the liquid seal from the outside in the form of very small air bubbles. Accordingly, the atmospheric air flows into the upper ink storage chamber 370, and the pressure in the upper ink storage chamber 370 returns to the atmospheric pressure. When the pressure in the upper ink storage chamber 370 is not reduced, the atmospheric air is not guided into the upper ink storage chamber 370 from the outside.

Thus, the amount of atmospheric air that flows into the ink storage chamber 370 through the atmosphere communicating path 150 is regulated to the minimum necessary amount. Therefore, quality degradation of the ink 1 due to contact between the ink 1 and fresh air can be suppressed. As a result, the quality of the ink 1 stored in the ink storage chambers 370, 390, and 430 can be stably maintained for a long time.

In addition, in the ink cartridge 1 according to the present embodiment, the through hole 372 that functions as the atmosphere outlet at one end of the thin communicating path 360 which provides the liquid seal is positioned near the bottom wall 375 of the upper ink storage chamber 370. The through hole 371 at the other end that functions as the atmosphere inlet is disposed at a position lower than the bottom wall 375 of the upper ink storage chamber 370 by the distance H1.

Therefore, when, for example, a predetermined amount of ink 1 is injected into the cartridge main body 10 in the manufacturing process, a necessary amount of ink 1 can be supplied to the thin communicating path 360 by the pressure of the ink 1 applied to the atmospheric air outlet in the upper ink storage chamber 370. Therefore, the liquid seal portion can be easily provided at the intermediate position of the atmosphere communicating path 150.

In addition, in the ink cartridge 1 according to the present embodiment, the thin communicating path 360 is substantially L-shaped. Therefore, a meniscus force is generated at the bent portion of the substantially L-shaped thin communicating path 360. The meniscus force exerts a holding force for restricting the movement (backward movement) of the ink 1 held in the thin communicating path 360 so as to form the liquid seal. Accordingly, the liquid-sealed state in which the ink 1 is held in the thin communicating portion 360 can be stably maintained.

In the above-described embodiment, three ink storage chambers are provided in a single cartridge main body. However, the number of ink storage chambers to be provided in the cartridge main body may be set to an arbitrary number selected from two or more. As the number of ink storage chambers is increased, the number stages of the traps for catching the air bubbles is increased and the performance of preventing the downstream movement of the air bubbles can be increased.

The application of the liquid storage container according to the present invention is not limited to the ink cartridge explained in the above-described embodiment. In addition, the liquid-consuming apparatus having a container-receiving unit to which the liquid storage container according to the present invention is attached is also not limited to the ink jet recording apparatus explained in the above-described embodiment.

The liquid-consuming apparatus may be any kind of apparatus which includes a container-receiving unit for receiving the liquid storage container in a detachable manner and to which the liquid contained in the liquid storage container is supplied. For example, the present invention may be applied to an apparatus including a color-material ejecting head used for manufacturing a color filter of a liquid crystal display or the like, an apparatus including an electrode-material (conductive paste) ejecting head used for forming electrodes of an organic EL display, a field emitting display (FED), etc., an apparatus including a living-organic-material ejecting head used for manufacturing biochips, an apparatus including a sample-ejecting head that functions as a precision pipette, etc.

What is claimed is:

1. A liquid storage container adapted to be attached to a liquid-consuming apparatus, the liquid storage container comprising:

a liquid storage chamber that stores liquid therein;

a liquid-supplying unit adapted to be connected to the liquid-consuming apparatus;

a liquid guide path configured to guide the liquid stored in the liquid storage chamber to the liquid-supplying unit;

an atmosphere communicating path configured to allow atmospheric air to flow into the liquid storage chamber from the outside as the liquid in the liquid storage chamber is consumed; and a liquid remaining-amount sensor disposed at an intermediate position of the liquid guide path and determining that the liquid in the liquid storage chamber has run out when a flow of gas into the liquid guide path is detected, wherein the atmosphere communicating path has a thin communicating path portion at an intermediate position thereof, the thin communicating path portion being thinner than other communicating path portions and being capable of holding a portion of the liquid stored in the liquid storage chamber by a meniscus, and wherein an amount of liquid sufficient for blocking the liquid stored in the liquid storage chamber from the atmospheric air is held in the thin communicating path portion, and wherein the liquid storage chamber includes a first liquid storage chamber communicating with the atmosphere communicating path, and a second liquid storage chamber disposed below and downstream from the first liquid storage chamber, and wherein the liquid guide path includes a descending connection path portion communicating with the first and second liquid storage chambers such that the liquid descends downward therethrough, one end of the descending connection path portion communicating with a liquid outlet of the first liquid storage chamber and the other end of the descending connection path portion communicating with a liquid inlet of the second liquid storage chamber, and wherein one end of the thin communicating path portion is positioned near a bottom wall of the first liquid storage chamber and positioned above the liquid outlet of the first liquid storage chamber, and the other end of the thin communicating path portion is positioned below the bottom wall of the first liquid storage chamber.

2. The liquid storage container according to claim 1, wherein an atmospheric air outlet at one end of the thin communicating path portion is positioned near a bottom wall of the liquid storage chamber, and wherein an atmospheric air inlet at the other end of the thin communicating path portion is positioned below the bottom wall of the liquid storage chamber.

3. A liquid storage container adapted to be attached to a liquid-consuming apparatus, the liquid storage container comprising:

a liquid storage chamber that stores liquid therein;

a liquid-supplying unit adapted to be connected to the liquid-consuming apparatus;

a liquid guide path configured to guide the liquid stored in the liquid storage chamber to the liquid-supplying unit;

an atmosphere communicating path configured to allow atmospheric air to flow into the liquid storage chamber from the outside as the liquid in the liquid storage chamber is consumed; and a liquid sensor disposed in the liquid guide path, wherein the atmosphere communicating path has a thin communicating path portion at an intermediate position thereof, the thin communicating path portion being thinner than other communicating path portions and being capable of holding a portion of the liquid stored in the liquid storage chamber by a meniscus, and wherein an amount of liquid sufficient for blocking the liquid stored in the liquid storage chamber from the atmospheric air is held in the thin communicating path portion, and wherein the liquid storage chamber includes a first liquid storage chamber communicating with the atmosphere communicating path, and a second liquid storage chamber disposed below and downstream from the first liquid storage chamber, and wherein the liquid guide path includes a descending connection path portion communicating with the first and second liquid storage chambers such that the liquid descends downward therethrough, one end of the descending connection path portion communicating with a liquid outlet of the first liquid storage chamber and the other end of the descending connection path portion communicating with a liquid inlet of the second liquid storage chamber, and wherein one end of the thin communicating path portion is positioned near a bottom wall of the first liquid storage chamber and positioned above the liquid outlet of the first liquid storage chamber, and the other end of the thin communicating path portion is positioned below the bottom wall of the first liquid storage chamber.

4. The liquid storage container according to claim 3, wherein the thin communicating path portion is thin enough to form a meniscus at any portion thereof.

5. The liquid storage container according to claim 3, wherein the thin communicating path portion is substantially L-shaped.

6. A liquid storage container adapted to be attached to a liquid-consuming apparatus, the liquid storage container comprising:

a liquid storage chamber that stores liquid therein;

a liquid-supplying unit adapted to be connected to the liquid-consuming apparatus;

a liquid guide path configured to guide the liquid stored in the liquid storage chamber to the liquid-supplying unit;

an atmosphere communicating path configured to allow atmospheric air to flow into the liquid storage chamber from the outside as the liquid in the liquid storage chamber is consumed; and a liquid remaining-amount sensor disposed at an intermediate position of the liquid guide path and determining that the liquid in the liquid storage chamber has run out when a flow of gas into the liquid guide path is detected, wherein the atmosphere communicating path has a thin communicating path portion at an intermediate position thereof, the thin communicating path portion being thinner than other communicating path portions and being capable of holding a portion of the liquid stored in the liquid storage chamber by a meniscus, and wherein an amount of liquid sufficient for blocking the liquid stored in the liquid storage chamber from the atmospheric air is held in the thin communicating path portion, wherein an atmospheric air outlet at one end of the thin communicating path portion is positioned within the liquid storage chamber near a bottom wall of the liquid storage chamber, and wherein an atmospheric air inlet at the other end of the thin communicating path portion is positioned below the atmospheric air outlet and below the bottom wall of the liquid storage chamber.

7. A liquid storage container adapted to be attached to a liquid-consuming apparatus, the liquid storage container comprising:

a liquid storage chamber that stores liquid therein;

a liquid-supplying unit adapted to be connected to the liquid-consuming apparatus;

a liquid guide path configured to guide the liquid stored in the liquid storage chamber to the liquid-supplying unit;

an atmosphere communicating path configured to allow atmospheric air to flow into the liquid storage chamber from the outside as the liquid in the liquid storage chamber is consumed; and a liquid sensor disposed in the liquid guide path, wherein the atmosphere communicating path has a thin communicating path portion at an intermediate position thereof, the thin communicating path portion being thinner than other communicating path portions and being capable of holding a portion of the liquid stored in the liquid storage chamber by a meniscus, and wherein an amount of liquid sufficient for blocking the liquid stored in the liquid storage chamber from the atmospheric air is held in the thin communicating path portion, wherein an atmospheric air outlet at one end of the thin communicating path portion is positioned within the liquid storage chamber near a bottom wall of the liquid storage chamber, and wherein an atmospheric air inlet at the other end of the thin communicating path portion is positioned below the atmospheric air outlet and below the bottom wall of the liquid storage chamber.

* * * * *